US006187166B1

(12) United States Patent
Moehle et al.

(10) Patent No.: US 6,187,166 B1
(45) Date of Patent: Feb. 13, 2001

(54) INTEGRATED SOLUTION ELECTROPLATING SYSTEM AND PROCESS

(75) Inventors: Paul R. Moehle, Seekonk; David M. Drew, Attleboro, both of MA (US); Stephen J. Smith, Lincoln, RI (US)

(73) Assignee: Texas Instruments Incorporated, Dallas, TX (US)

( * ) Notice: Under 35 U.S.C. 154(b), the term of this patent shall be extended for 0 days.

(21) Appl. No.: 09/294,218

(22) Filed: Apr. 16, 1999

Related U.S. Application Data

(60) Provisional application No. 60/082,474, filed on Apr. 21, 1998.

(51) Int. Cl.[7] ..... C25D 7/06

(52) U.S. Cl. ..... 205/138; 205/152; 204/206; 204/207; 204/227; 204/211; 204/241

(58) Field of Search ..... 204/206, 207, 204/211, 227, 241; 205/152, 153, 154, 155, 156, 137, 138, 139, 140, 141, 142, 143

(56) References Cited

U.S. PATENT DOCUMENTS

| | | | | |
|---|---|---|---|---|
| 3,870,618 | * | 3/1975 | Seyb, Jr. et al. | 204/206 |
| 4,662,997 | * | 5/1987 | Hirt et al. | 204/206 |
| 6,007,694 | * | 12/1999 | Walsh et al. | 205/646 |

* cited by examiner

*Primary Examiner*—Bruce F. Bell
(74) *Attorney, Agent, or Firm*—Gary C. Honeycutt; Fred Telecky; Arthur I. Navarro

(57) ABSTRACT

A method and system for electroplating a metal coating onto a continuous part, such as the leadframe stock used in packaging integrated circuits, whereby the method comprises plating metal from a series of plating baths having the same or compatible chemical composition, supplying a continuous electrical connection between the D.C. power supply via a rotating contact held in intimate contact with the cathode, and cooling the contact by using the plating solution itself.

13 Claims, 5 Drawing Sheets

INTEGRATED SOLUTION ELECTROPLATING SYSTEM AND PROCESS

This application claims the benefit of provisional application 60/082474 filed Apr. 21, 1998.

FIELD OF THE INVENTION

This invention relates generally to the field of electroplating, and more particularly to continuous electroplating of metals used in the interconnection of electronic devices.

BRIEF DESCRIPTION OF PRIOR ART

A large variety of articles are made onto which high quality precious and non-precious metals are electroplated for protective coatings. Particularly well known are jewelry articles where metal coatings improve appearance. In many other applications, metal coatings are used for surface protection to prevent corrosion and/or serve as a diffusion barrier, as for example in the fabrication of electronic devices. In other applications of electrical or electronic devices, metal films are used as electrical contact surfaces. In many of these applications, metal films which have high purity, are free of defects, and have controlled thickness and hardness are required. These quality levels and the necessary manufacturing controls contribute to a significant increase in the cost of such articles.

Integrated circuit devices, having an integrated circuit chip and a lead frame which are sealed within a protective enclosure find wide use in products, among which are consumer electronics, computers, automobiles, telecommunications and military applications. A means to electrically interconnect an integrated circuit chip to circuitry external to the device frequently takes the form of a lead frame. The lead frame is formed from a highly electrically conductive material, such as copper or copper alloys, which are stamped or etched into a plurality of leads and a central area in which the integrated circuit chip is attached. The chip is electrically connected to the leads, usually by wire bonding and the device is encapsulated to provide mechanical and environmental protection. The surface finish of the lead frame plays and important role in the ability to attain a reproducible manufacturing process for connecting the chip. In turn, the required surface finish contributes to lead frames being the most costly piece part used in the assembly of plastic encapsulated integrated circuits.

In plating applications where it is feasible, there are cost advantages to plating a continuous part, as opposed to individual pieces. For relatively thin articles, use of a reel to reel handling mechanism allows continuous plating of long pieces with a minimum number of intervention and consequently fewer opportunities for contamination of the plating baths. In particular, this technique has been applied to the manufacture of thin metal coatings on lead frames for interconnecting integrated circuits.

While automation techniques, such as continuous plating of lead frames do help to reduce costs, expenses associated with plating also involves productivity of the plating lines, cost and maintenance of equipment, cost of plating chemicals and high purity water, and of increasing concern, the cost of waste treatment associated with plating chemicals. Methods to help decrease these costs is of ongoing interest to the industry.

SUMMARY OF THE INVENTION

In accordance with the present invention, there is provided a system for electroplating metal coatings onto a continuous metal article which reduces costs, and secondly, there is provided a process aiming at high productivity plating with a reduction in the number of process steps, process time, and chemical costs. This system and process is applicable to plating lines which have a series of plating cells containing the same or compatible chemical solutions.

It is an object of the invention to provide a cost effective plating system which conserves plating solution by minimizing the amount of said solution wasted as a result of the part to be plated being transported between tanks having different solutions.

Another object of the invention is to provide a process for electroplating which minimizes water consumption by using the plating solution itself for cooling the contacts.

Yet another object is to provide a process which reduces the need for waste treatment of cooling water contaminated with plating solution.

A further object of the invention is to provide a relatively short plating line which allows a linear space reduction.

A further object is to provide a system which avoids costs associated with additional equipment and plumbing required for cooling the electrode by exposure to a chemical solution different from the plating bath, such as cooling water.

A further object of the invention is to provide a system which minimizes damage to fragile parts caused by excess line tension.

A further object is to provide a system having a continuous electrical connection between the D.C. power supply and a rotating cathode contact.

Another object of the invention is to provide a process having a relatively high speed and throughput.

Other objects and advantages of the present invention will become apparent from the following descriptions, taken in connection with the accompanying drawings, wherein, by way of illustration and example, an embodiment of the present invention is disclosed.

A system for electroplating a metal coating onto a continuous article, which constitutes the cathode from a series of plating tanks having the same or compatible plating solutions, and in which said system comprises a continuous electrical connection between the D.C. power supply and the cathode via a rotating contact and wherein the contact cell wherein the rotating cathode contact is cooled by integrating the plating solution itself into the contact cell. The plating system with integrated plating solution cooling is applicable to, but not limited to continuous or reel to reel plating of metal coatings, such as nickel and copper onto a metal piece which constitutes the cathode. The cathode is a strip of metal, for example, copper or a copper alloy which is used for, but not limited to, the production of electronic parts, such as lead frames which provide electrical interconnection in integrated circuit packaging.

A system whereby continuous electrical connection between the D.C. power supply and the cathode is via a rotating contact which is maintained in continuous intimate contact by a non-rotating conductor secured with weights. Alternately, there is provided a system whereby continuous electrical connection between the D.C. power supply and cathode is via a rotating connector which is maintained in intimate contact by a mercury contact.

A process for electroplating a continuous part as it is transported through a series of tanks having the same or compatible chemical composition, wherein said process comprises passing a continuous current from the D.C. power supply to the cathode, and cooling the cathode contact by use of the plating bath solution itself.

The drawings constitute a part of this specification and include exemplary embodiments to the invention, which may be embodied in various forms. It is to be understood that in some instances various aspects of the invention may be shown exaggerated or enlarged to facilitate understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for teaching one skilled in the art to employ the present invention in virtually any appropriate detailed system, structure or manner.

Figure 1:
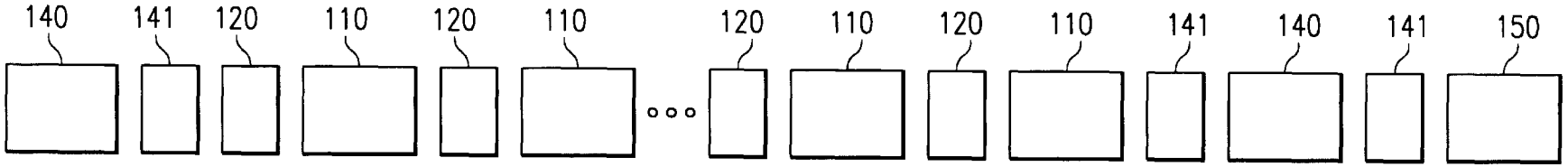
FIG. 1 (PRIOR ART)
FIG. 1 depicts a portion of continuous plating line from prior art.
Figure 2A:
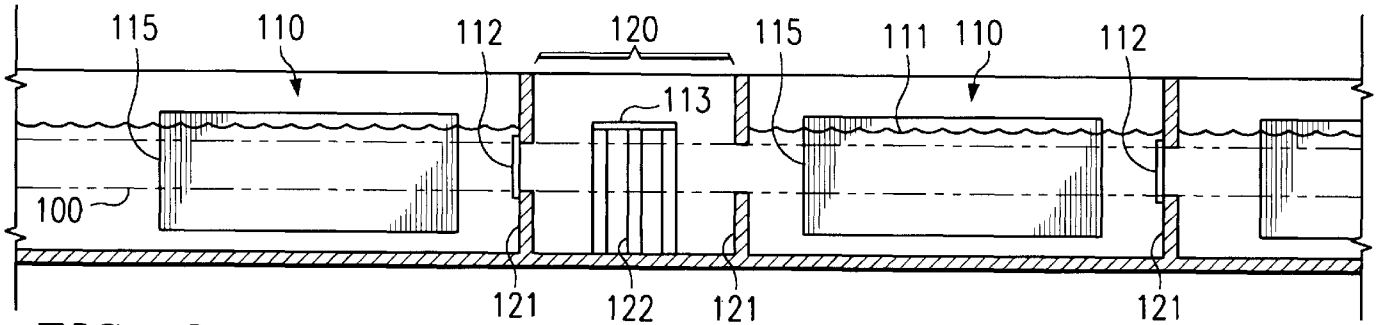
FIG. 2a (PRIOR ART)
FIG. 2*a* gives detail of two cells from a plating line of known art.

Turning now to the drawings, FIG. 1 schematically provides an example of a continuous plating line wherein the part to be plated is passed through a series of cells for cleaning, rinsing, plating and making electrical contact; included in this line is a series of cells having the same plating bath composition. Only that portion of the plating line is pertinent to the present invention. Multiple cells having the same bath composition are used to maintain line balance while processing articles where the plating material deposits slowly or where a thicker coating is required. It can be seem from the diagrams that a cleaning bath 140 and associated rinse station 141 are placed prior to plating baths. In this configuration, there are a series of cells having the same bath composition 110 and between each of these cells is a contact station 120. These are followed by another clean 140 and rinse 141 station prior to a cell which contains a different plating solution. The drawing in FIG. 2 shows a section of the line with two of the series of cells having the same bath composition, and in which it can be seen that there are walls 121 and space separating the plating cell 110 from the contact mechanism 122. This contact mechanism and the associated space require about a minimum of 25 inches of linear space and the contacts are are placed in the range of about 65 inches apart.

In an attempt to control the amount of plating solution which is dragged from the plating cell, rubber rollers or squeeges 112 are placed at the openings of the plating cells to help contain the solution and remove it from the article being plated. From the top view, shown in FIG. 2*b*, it can be seen that there are two drains provided; one 123 for overflow plating solution and the second, 124 for rinse water and any diluted plating solution dragged into this area.

Figure 2B:
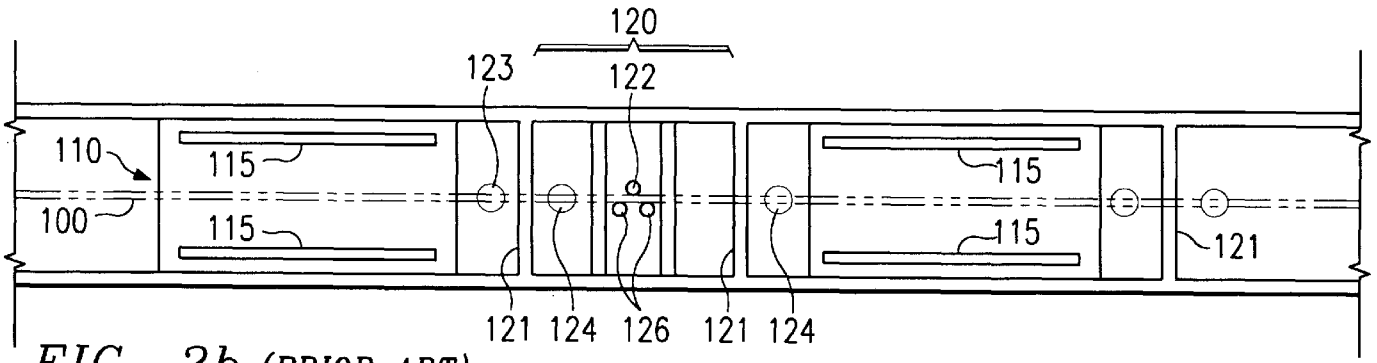
FIG. 2b (PRIOR ART)
FIG. 2*b* gives top view of two plating cells of known art.
Figure 3:
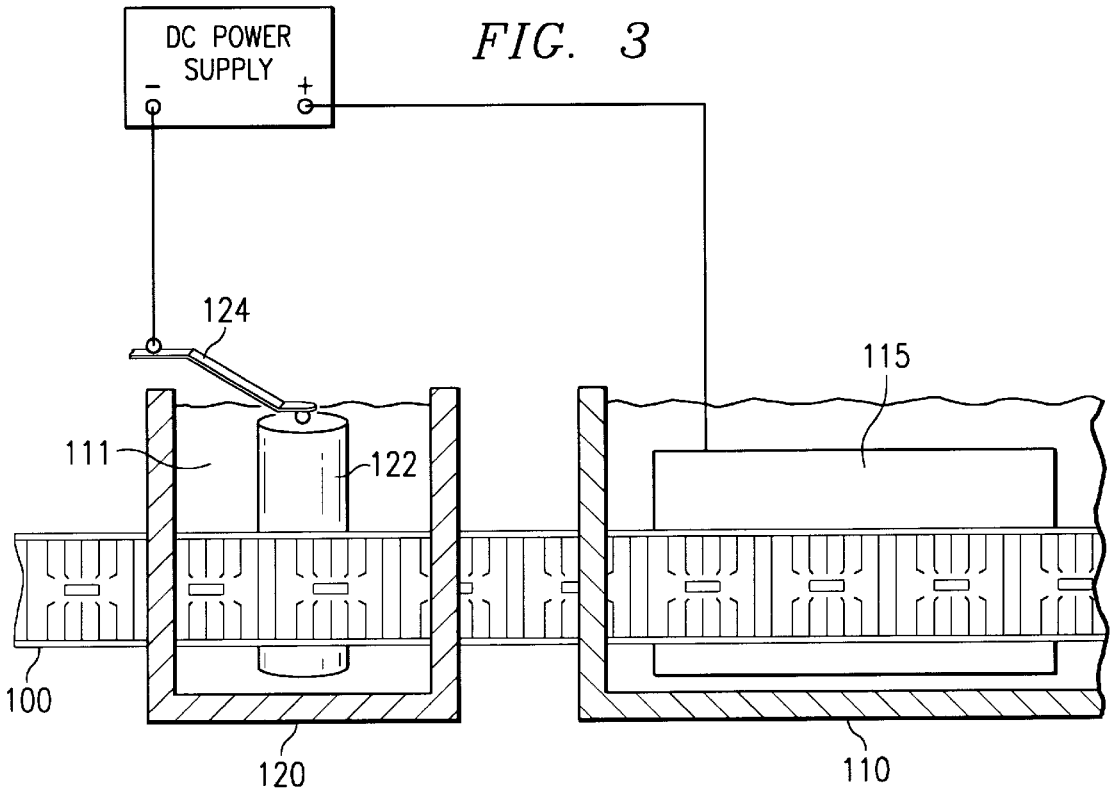
FIG. 3 provides the flow of electrical current to active components in an electroplating process.

It can further be seen in FIG. 2 that there is a plating solution 111 in which the metal strip 100 to be plated is immersed. FIG. 2*b* shows an anode 115 located within the plating cell and the metal strip 100 to be plated constitutes the cathode. Electrical contact to the cathode 100 is made by means of a rotating metal contact 122 located within the contact cooling station 120. Plastic contact rollers 126 support the metal strip in mechanical contact against the rotating electrical contact 122. Electrical connection is made from a D.C power supply (not shown) via a non-rotating wire or feeler 124 to the rotating contact 122, and in turn to the metal strip 100, as depicted in FIG. 3.

The plating system configuration in FIG. 2 provides that no plating solution is present where electrical current is supplied to the cathode; i.e., at the point of contact. Instead, contact to the cathode 100 and cooling of the contact is made under clean water 113 in order to avoid plating metal from the plating solution onto the contact mechanism. Such inadvertent plating onto the contact mechanism results from introduction of a voltage potential caused by a break in the electrical connection between the rotating contact 122 and the feeler or non-rotating contact 124. Owing to the fact that the feeler 124 has a higher negative charge than the larger rotating contact 122, the feeler could plate up if the plating electrolyte were present and would subsequently result in a contact failure. This contact failure, in turn would allow the rotating contact to corrode quickly. This problem has been avoided by submerging the contact mechanism in clean water which has minimal contamination from the plating solution for cooling.

The system of FIGS. 1 and 2 has been in place for a number of years, but is somewhat inefficient with respect to conservation of space used for cooling contact cells, for chemical loss and waste recovery, and for costly maintenance of the system.

Figure 4:
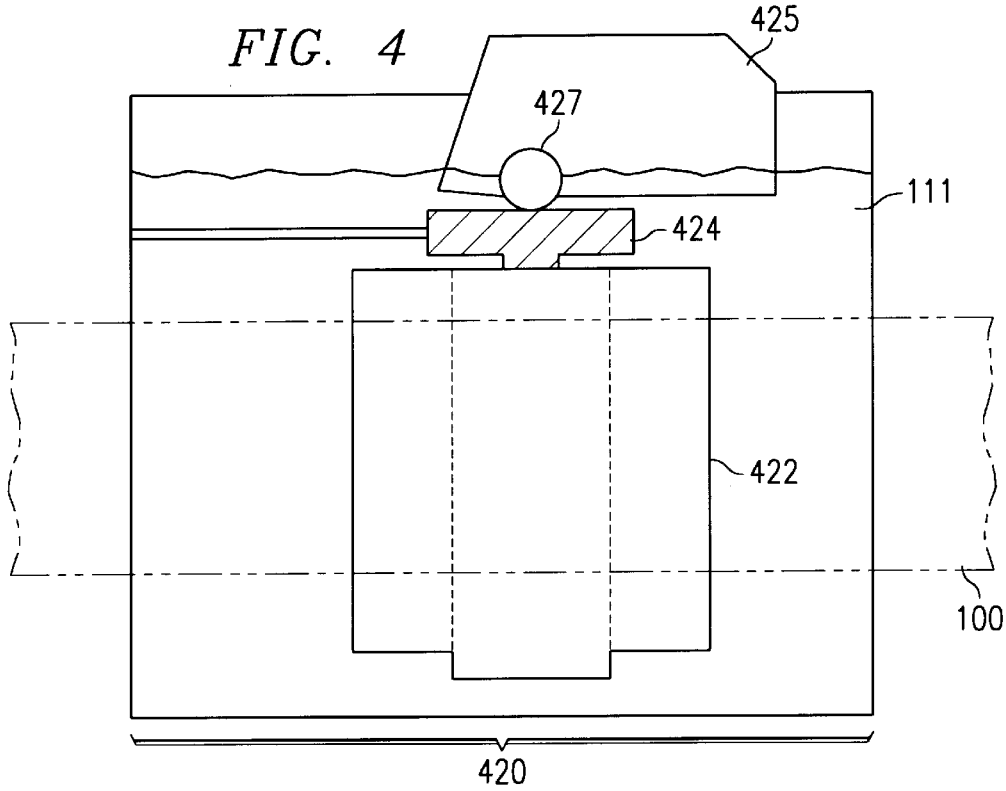
FIG. 4 shows a diagram of a continuous current contact mechanism.

To explain the present invention, a cathode contact cell 420 diagrammed in FIG. 4. The contact mechanism provides for reliable, continuous contact between non-rotating feeler 424, the rotating contact 422 and the metal strip 100 to be plated which constitutes the cathode. The feeler 424 is maintained in intimate contact with the rotating contact 422 by a system of hold down weights 425 on a hinge 427. Owing to the fact that there is no contact loss or resulting build-up of voltage potential at the feeler, contact is made in the presence of the plating solution 111 without concern for deposition of plated material on the feeler and subsequent contact failure as described above.

Figure 5A:
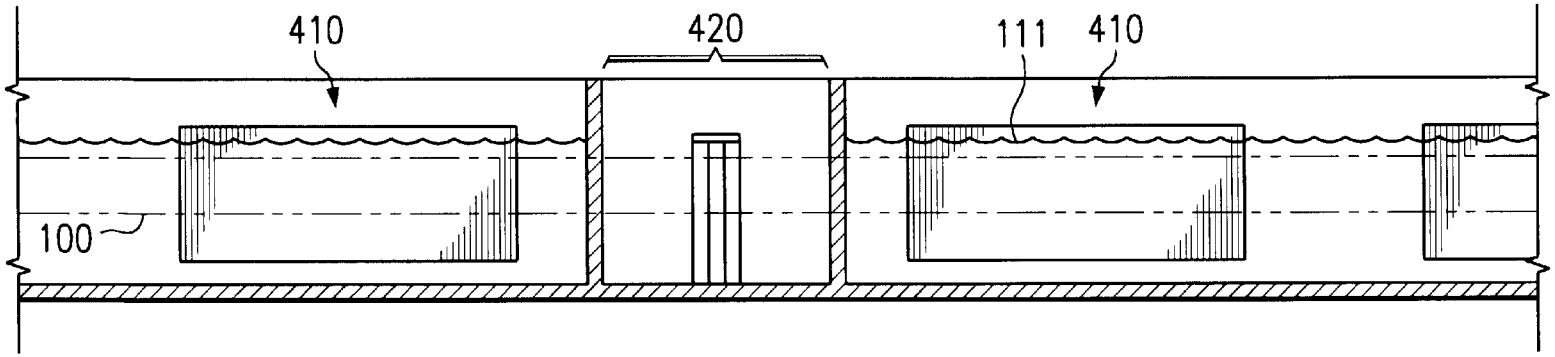
FIG. 5*a* shows detail of 2 cells which include integrated solution cooling.
Figure 5B:
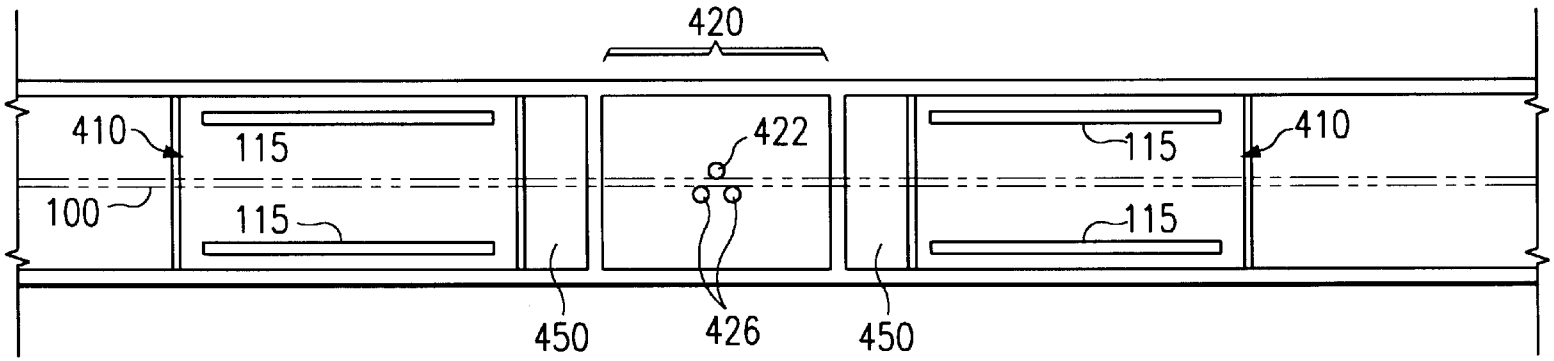
FIG. 5*b* gives a top view of two cells with integrated solution cooling.

The redundant plating and contact cells of this invention are diagrammed in FIGS. 5*a* and 5*b*, wherein the plating solution is integrated into the contact cell for cooling. Owing to the fact that the plating solution is used to cool the contact, only a short transition line space 450 between the plating cell 410 and contact cell 420 is needed. The transition space can be about 2.5 inches on each end and the contact mechanism about 5 inches in length. Distance between contact mechanisms is about 50 inches in length. By comparison to the previous system, a space reduction of about 20% is gained. The plating system provided in this invention allows increased line speed and productivity as a result of the short contact station with integrated plating solution cooling.

A drain for water contaminated by drag out from the plating solution is eliminated. In addition, a significant cost savings is realized by avoiding a need for waste recovery associated with contaminated water for contact cooling.

Further, a system of squeegees 112 or rubber rollers designed to prevent drag out of plating solution into the contact cell is unnecessary. In addition to elimination of squeege parts and their maintenance, tension on the part to be plated caused by such devices is avoided, thereby eliminating damage to fragile parts which can result from this contact and tension.

Figure 6:
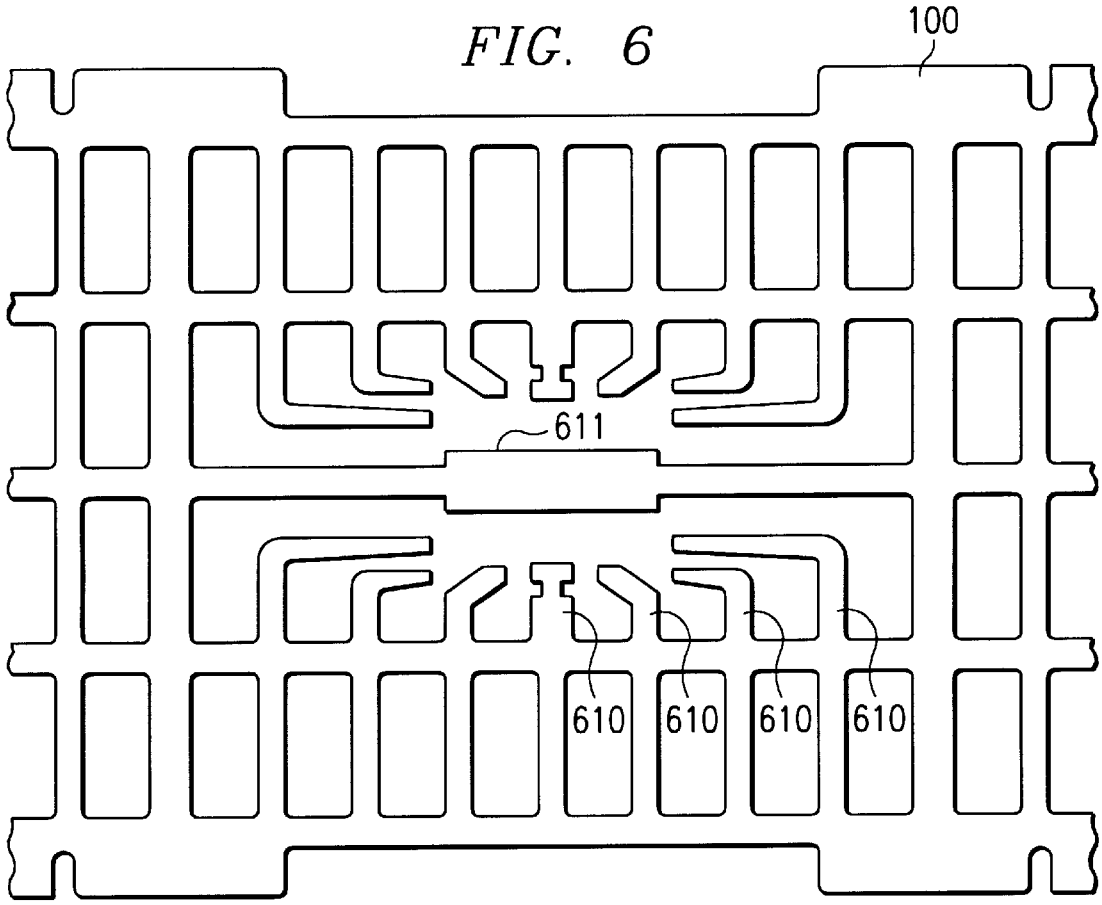
FIG. 6 depicts a typical lead frame design.
Figure 7A:
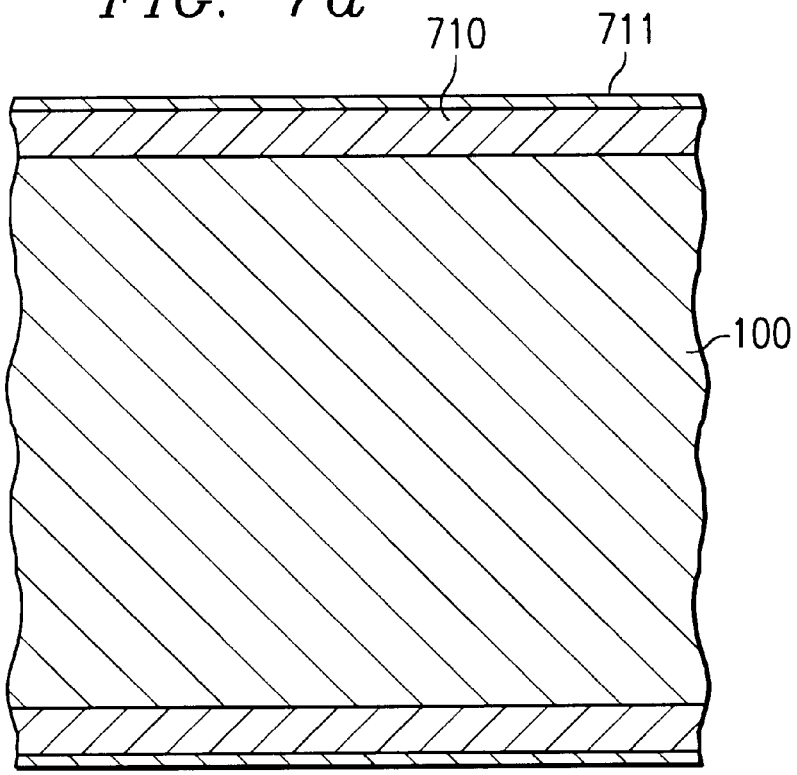
FIGS. 7A and 7B provide a cross section of metal coatings on a lead frame and the lead frame in a encapsulated integrated circuit device.
Figure 7B:
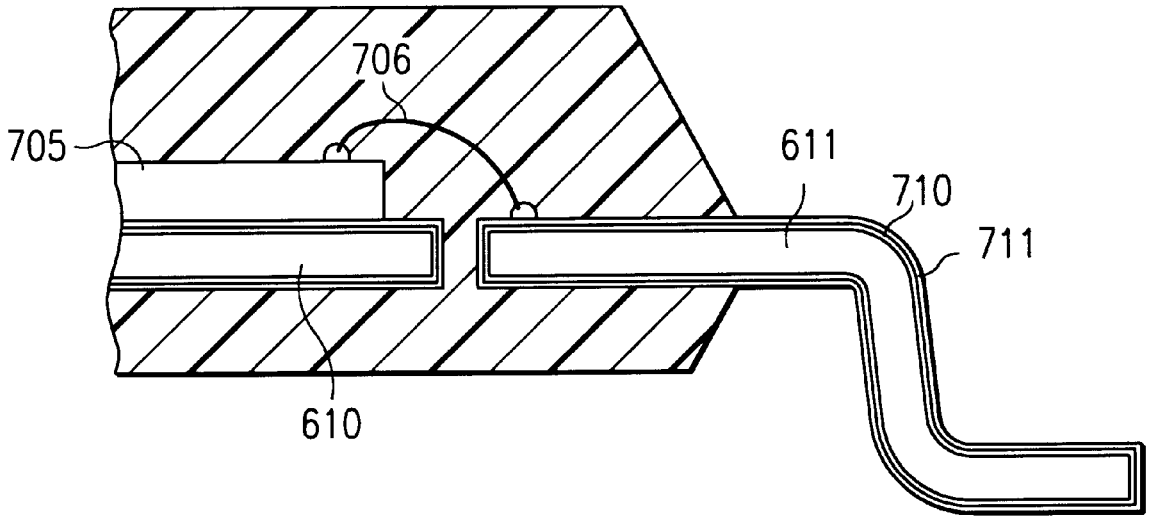

In the preferred embodiment a relatively thick layer of nickel is plated onto a strip of copper alloy which is used as lead frames in the interconnection of integrated circuits. Typically for this application, the thick nickel coat is followed by a very thin coating of a noble metal, such as palladium, silver or gold and for this example, the plating system configuration consists of multiple nickel plating baths and one noble metal bath. FIG. 6 provides an example of a lead frame which has been formed by etching or stamping a plurality of lead fingers 610 and providing a central area 611 where the integrated circuit chip will be attached. In the continuous plating process, hundreds of such lead frame units will be formed from a continuous roll of lead frame metal stock. In the preferred embodiment, said patterned metal strip is in the range of 0.007 to 0.020 inches thick by 0.5 to 3.5 inches wide and the length is greater than the length of the plating line and is continuous. FIG. 7 provides a cross sectional view of plating layers on lead frame stock 100 where the typical thickness for the nickel layer 710 is in the range of 20 to 150 microinches and the subsequently plated noble metal 711 is in the range of 2 to 10 microinches thickness. These coatings are shown (not to scale) in FIG. 7B on a lead frame with an integrated circuit 705 mounted onto the chip pad and interconnected by wire bond 706 to a lead finger 611.

It is further shown in FIG. 4 that the full width of the cathode metal strip 100 is in contact with the rotating contact 422 and therefore the contact must be equal to or greater in length than the cathode width 100. In the preferred embodiment, said length of the rotating contact 422 is about 3.5 inches.

Turning now to the preferred process for plating a metal coating onto a continuous article by using the plating system of this invention. A reliable, low cost process which is compatible with low cost manufacturing is provided. In order to provide the nickel thickness and quality required, multiple passes of the lead frame strip 100 through nickel sulfamate plating baths 110 are made; several cells in series 410 as necessary to provide the plating thickness are used to maintain the plating line balance. As is typical of electroplating processes, immediately prior to plating, the metal strip is processed through cleaning 140 and rinse 141 cells, as in the existing process. Process steps of the preferred embodiment are as follows; the clean copper strip 100 is immersed in plating solution 111 in the contact cell 420 where negative contact from the D.C. power supply is made by way of a rotating contact 422. Said strip 100 is supported against the rotating contact 422 by two plastic rollers 426. Current is continuously supplied from a D.C. power supply to the metal strip which constitutes the cathode as it is transferred through the first nickel plating cell 410. Metal strip 100 is transported in series through the series of and plating baths using the same procedure. The contact cell immediately following the final plating cell contains rinse water as in the existing process, not plating solution. After rinse the clean strip is transferred to a plating bath 150 of different composition, such as a noble metal bath.

In summary, a plating system and a process are provided whereby a metal, such as nickel is plated onto a continuous strip of lead frame stock material, such as copper, and whereby the nickel is plated in a series of baths having the same composition. Electrical contact is constantly maintained to the lead frame material by a rotating contact; said rotating contact is housed in a small area cell and is cooled by the plating bath solution, thereby providing a low cost plating system.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A system for electroplating a metal coating onto a continuous article which constitutes the cathode from a series of plating cells having the same or compatible plating solutions, wherein said system comprises:

a continuous electrical connection between the D.C. power supply and said cathode via a rotating contact; and a contact cell wherein the rotating contact is cooled by the plating solution.

2. A system as in claim 1 wherein continuous electrical connection to the rotating contact is assured by a non-rotating electrical contact held in intimate contact.

3. A device as in claim 2 wherein said non-rotating contact is held in intimate contact by a system of weights.

4. A device as in claim 2 wherein said non-rotating contact maintains intimate contact by a mercury contact.

5. A device as in claim 2 wherein the non-rotating contact is about 0.01 inches thick and about 0.5×1.5 inches.

6. A system as in claim 1 wherein the contact cells are in the range of 5 to 10 inches in length.

7. A system as in claim 1 wherein the contact cells are placed about 50 inches apart.

8. A system as in claim 1 wherein the temperature of the rotating cathode contact is maintained at approximately the temperature of the plating bath.

9. A system as in claim 1 wherein the rotating contact is about 1.5 inches in diameter by 3.5 inches in length.

10. A system as in claim 1 which is used to plate lead frame stock material.

11. A system for electroplating a metal coating onto a continuous article which constitutes the cathode from a series of plating cells having the same or compatible plating solutions wherein said system comprises:

a continuous electrical connection between the D.C. power supply and said cathode via a rotating contact;

a contact cell wherein the rotating contact is cooled by the plating solution;

a continuous electrical connection to the rotating contact is assured by a non-rotating electrical contact held in intimate contact by a system of weights, and a contact cell wherein the temperature of the rotating cathode contact is maintained at approximately the temperature of the plating bath.

12. A system for electroplating metal coatings onto lead frame stock material which constitutes the cathode from a series of plating cells having the same or compatible plating solutions, wherein the system comprises:

a continuous electrical connection between the D.C. power supply and said cathode via a rotating contact;

a contact cell wherein the rotating contact is cooled by the plating solution;

a continuous electrical connection to the rotating contact is assured by a non-rotating electrical contact held in intimate contact by a system of weights;

a contact cell wherein the temperature of the rotating cathode contact is maintained at approximately the temperature of the plating bath;

a non-rotating contact is about 0.01 inches thick and about 0.5×1.5 inches, and a contact cell that is about 5 inches long, and the contact cells are placed about 50 inches apart.

13. A process for electroplating metal coating onto a continuous article from a series of plating baths having the same or compatible plating solutions comprising:

immersing said article in plating solution, passing D.C. current to said article by way of a rotating contact maintained in continuous electrical contact by a non-rotating contact, cooling the contact by using plating solution, and transporting said article through each of the series of plating baths having the same composition using the same process for electrical contact and cooling.

* * * * *